United States Patent [19]

Shackelford

[11] Patent Number: 4,890,732

[45] Date of Patent: Jan. 2, 1990

[54] APPARATUS FOR BRUSHING TEETH WITH HYGIENIC DISPOSABLE BRISTLES

[76] Inventor: Renee M. F. Shackelford, 1830 Garraux Rd., N.W., Atlanta, Ga. 30327

[21] Appl. No.: 170,339

[22] Filed: Mar. 18, 1988

[51] Int. Cl.[4] ..... A46B 9/04; A46B 7/04

[52] U.S. Cl. ..... 206/362.1; 15/145; 15/167.1; 15/176.4; 132/309; 132/310

[58] Field of Search ..... 15/16.7, 176.1, 145, 15/176.5; 132/308, 309, 310; 206/361, 362.1

[56] References Cited

U.S. PATENT DOCUMENTS

| | | | |
|---|---|---|---|
| 1,797,946 | 3/1931 | Eichel | 15/176.1 |
| 1,849,769 | 3/1932 | Priest | 132/309 |
| 2,159,914 | 5/1939 | Tweedale | 15/176.5 |
| 4,362,174 | 12/1982 | Baker et al. | 132/310 |
| 4,543,679 | 10/1985 | Rosofsky | 15/167 R |

FOREIGN PATENT DOCUMENTS

| | | | |
|---|---|---|---|
| 2910817 | 10/1980 | Fed. Rep. of Germany | 15/176.1 |

*Primary Examiner*—Edward L. Roberts
*Attorney, Agent, or Firm*—Julius R. Lunceford, Jr.; Stephen M. Schaetzel; Carl M. Davis, II

[57] ABSTRACT

A toothbrush has a removable brush unit, and a handle; and, a plurality of brush units is packaged within a box that also includes dental floss. The box has lips to retain the handle in place on the container, and the bases of the brush units effectively close the compartments to maintain the cleanliness of brush units. The toothbrush handle has a recess to receive a base on the brush unit so that handle can be manipulated to pick up a brush unit from the box. Two or more boxes can be stacked to provide a larger supply of brush units.

32 Claims, 3 Drawing Sheets

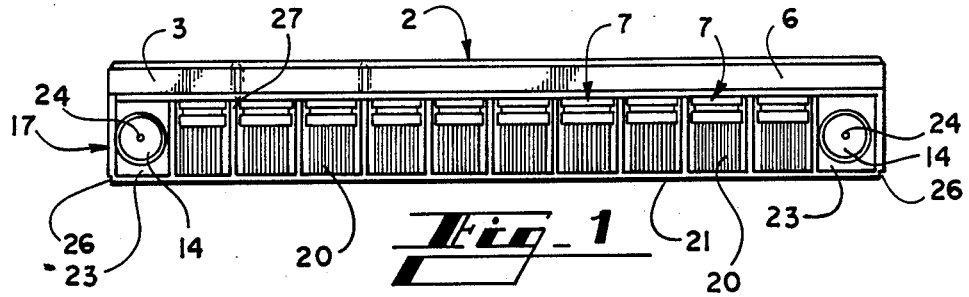
Fig. 1
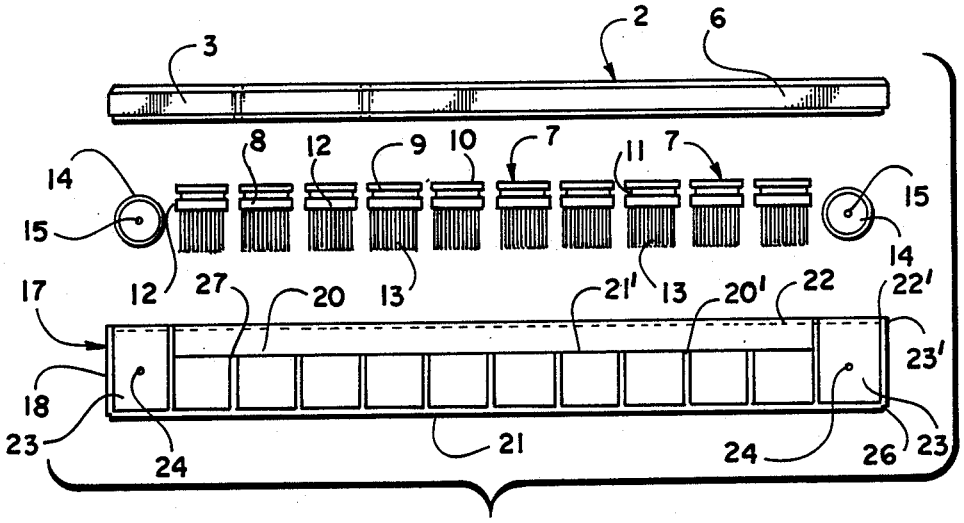
Fig. 2
Fig. 3
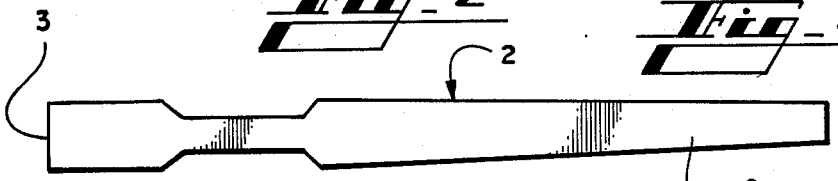
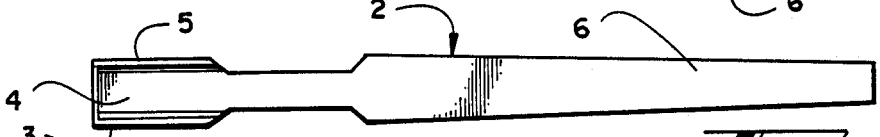
Fig. 5
Fig. 7
Fig. 4
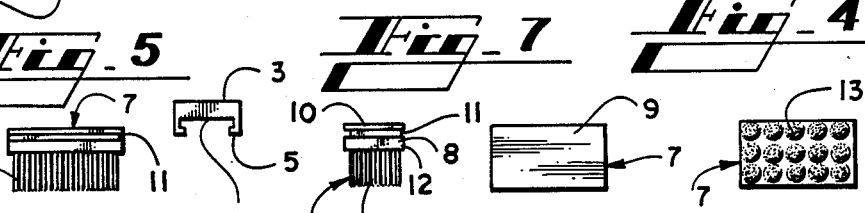
Fig. 6
Fig. 8
Fig. 9

APPARATUS FOR BRUSHING TEETH WITH HYGIENIC DISPOSABLE BRISTLES

BACKGROUND OF THE INVENTION

1. Field of the Invention

The present invention is characterized as a method of brushing teeth with hygienic disposable bristles and a combination of apparatus to accommodate the new practice which is generally related in nature and substance to toothbrushes and, more particularly, is concerned with an improved toothbrush assembly, comprising: a reusable handle unit releasably engageable with a disposable brush unit having a base carrying hygienic bristles, preferably conditioned as antiseptic bristles for use in combination with a dispensing container having means for releasably storing and dispensing a supply of the essential elements of the present invention.

2. Description of the Prior Art

It appears from the general state of the prior art and closest common practices and technology defined in the closest prior art covering method and apparatus generally relating to toothbrushes, that toothbrushes, heretofore, have been concerned only with a manufacture defined as a toothbrush unit, comprising: a handle and a base carrying bristles, both elements of which are, by their nature and substance, simultaneously reusable, the bristles of which may be regarded as contaminated bristles after repeated use and, as such, may be regarded as potential cause of problems of a hygienic nature in the common practice of brushing teeth.

There is described in U.S. Pat. No. 4,543,679, dated Oct. 1, 1985, a TOOTHBRUSH ASSEMBLING COMBINING A HANDLE WITH A REPLACEABLE BRUSH ASSEMBLY AND A REPLACEABLE ORAL HYGIENE DEVICE, inventors for which are listed as Paul M. Rosofsky, Willingboro, N.J.; and Alfred M. Blumenfeld, Melrose Park, Pa., application Ser. No. 433,424 filed Oct. 8, 1982. A copy of the patent document is herein attached. The inventive subject matter of the above cited invention describes a toothbrush assembly combining a handle with a complicated replaceable brush assembly and a replaceable oral hygiene device. This prior art provides for a brush assembly which is organized for repeated use as a type of oral hygiene device. The above invention, therefore, does not address the hygienic problems inherent in the prior art wherein bristles, by their nature and substance, have means for repeated use only and is, thus, not concerned with the improved hygienic standards presented by the present invention in its provision for the use of disposable bristles, and preferably, antiseptic bristles, in the common practice of brushing teeth.

It appears, therefore, that the prior art, generally, is not concerned with the potential hygienic problems inherent in the present practice of repeatedly using the same bristles in the common practice of brushing teeth, bristles which, once used, may be regarded as contaminated and, as such, may be further regarded as potentially a cause for medical problems related to inadequate oral and dental hygienic care.

It further appears, from the general state of the prior art and closest common practices and technology defined therein covering method and apparatus generally relating to tooth-brushing that there is no known toothbrush apparatus for brushing teeth with disposable bristles and no known container for storing and dispensing a supply of the essential elements associated with the inventive toothbrush apparatus combination, comprising: a reusable handle, a plurality of disposable brush units having a base carrying bristles, and preferably, antiseptic bristles; and other oral dental hygienic accessories herein described as a supply of dental tape and dental floss.

It is, thus, noted that a need exists in the art for the provision of some technique and device for overcoming the problems and deficiencies cited in the prior art for which the present invention is the solution by means of its provision for method and apparatus to accommodate the new practice of brushing teeth with disposable bristles in the common practice of brushing teeth.

SUMMARY OF THE INVENTION

The present invention provides a combination of toothbrushing apparatus which overcomes the aforementioned problems and satifies the needs outstanding in the common practice of brushing teeth by providing a system for brushing teeth with hygienic disposable bristles and apparatus to accommodate the new practice, as follows: an improved toothbrush assembly for use in combination with a dispensing container having means for hygienically storing a supply of the disposable bristles and means for utilizing the hygienic disposable bristles dispensed therefrom which eliminates the aforesaid problem of reusing bristles which may be contaminated.

Accordingly, the invention relates to method and a combination of apparatus for brushing teeth with hygienic disposable bristles which includes: means for storing a reusable handle unit; means for storing a plurality of hygienic disposable brush units having a base carrying hygienic bristles; and means for assembling of the toothbrush in cooperation with the dispensing container. The essential elements of the apparatus combination are recited, as follows: the reusable handle unit having a handle end region shaped for manipulation by a user of the toothbrush and a head-end region shaped for releasable engagement with an upper region of the base carrying hygienic disposable bristles; the hygienic disposable brush unit base having an upper region shaped for releasable engagement with the handle head end and a base lower region carrying the hygienic bristles, and preferably antiseptic bristles which may be treated, in addition, for a dentifrice content; and the dispensing container having a unilinear section body member having means for storing the reusable handle onto the dispensing container; means for storing the plurality of hygienic disposable brush units within the container; and means for storing a pair of ordinary spools carrying a content of dental floss and dental tape.

The user convenience and the aesthetic qualities of the inventive method and apparatus for brushing teeth with disposable bristles, and preferably antiseptic bristles, and better oral and dental hygienic care and health considerations are cited as the objects of the present invention rendering the present invention both novel and useful.

BRIEF DESCRIPTION OF THE DRAWINGS

In the detailed description of the preferred embodiments of the inventive subject matter and best mode contemplated by the inventor for carrying out the present invention, reference is made to the accompanying drawings in which:

FIG. I is a front elevational view of a disposable toothbrush and container made in accordance with the present invention;

Figure 10:
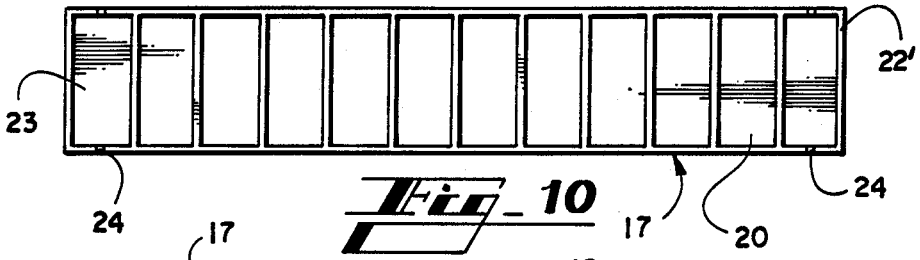
Figure 11:
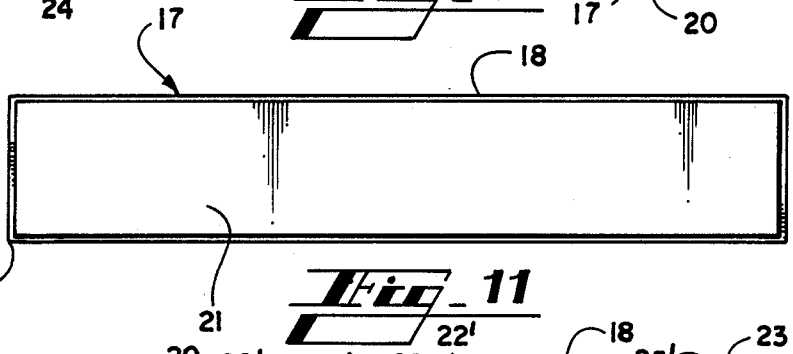
Figure 12:
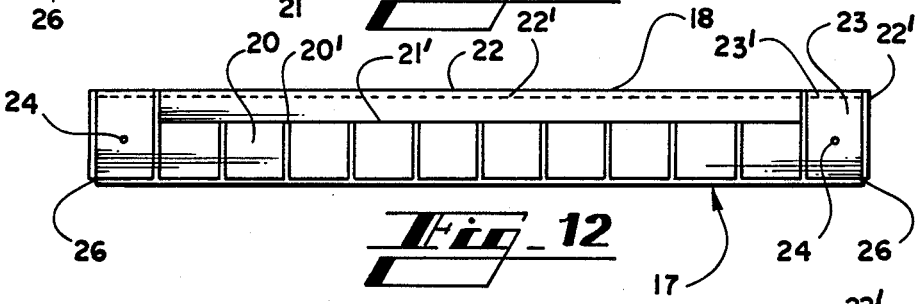
Figure 13:
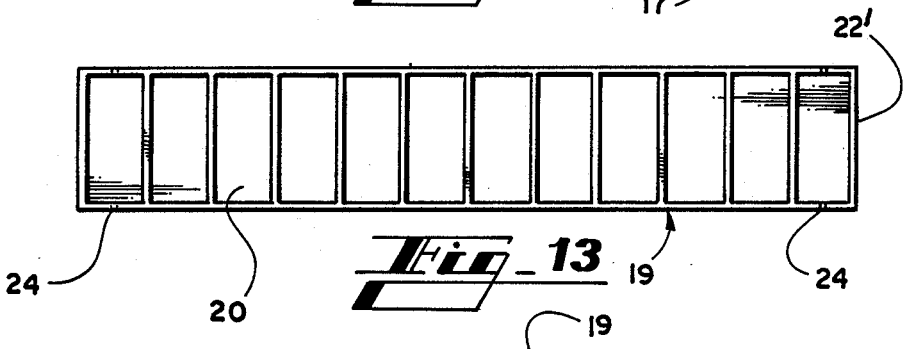
Figure 14:
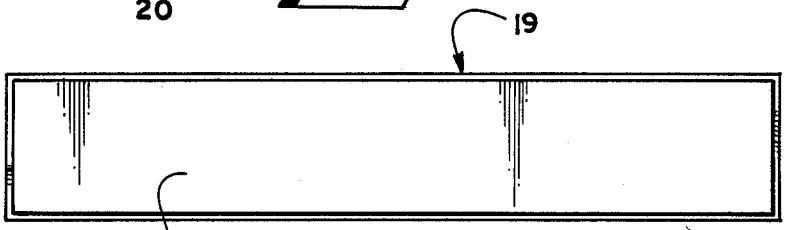
Figure 15:
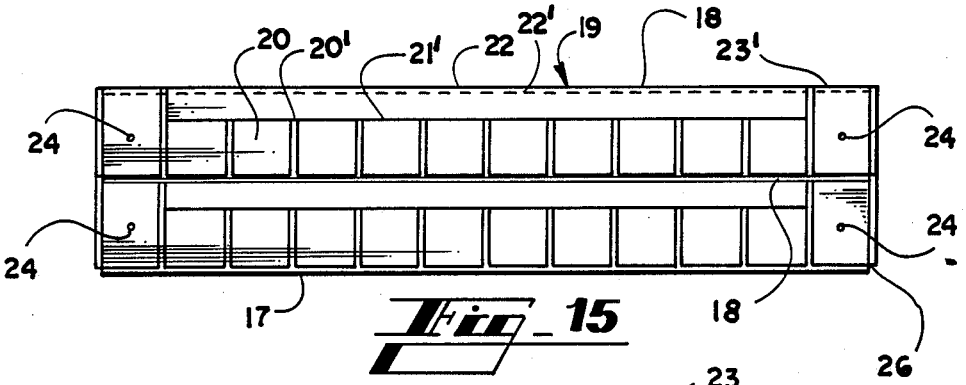
Figure 16:
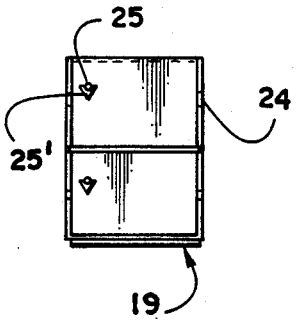
Figure 17:
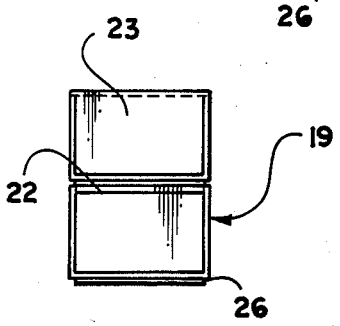
Figure 18:
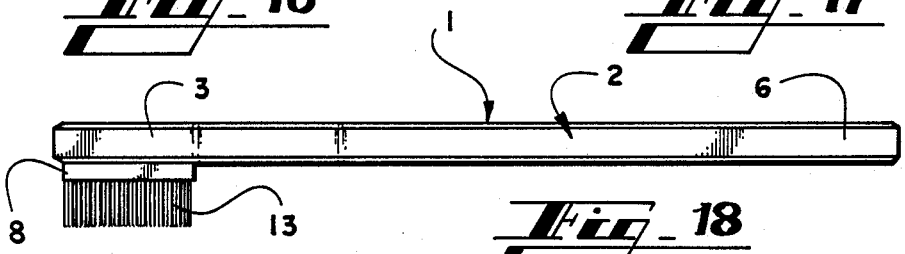
Figure 19:
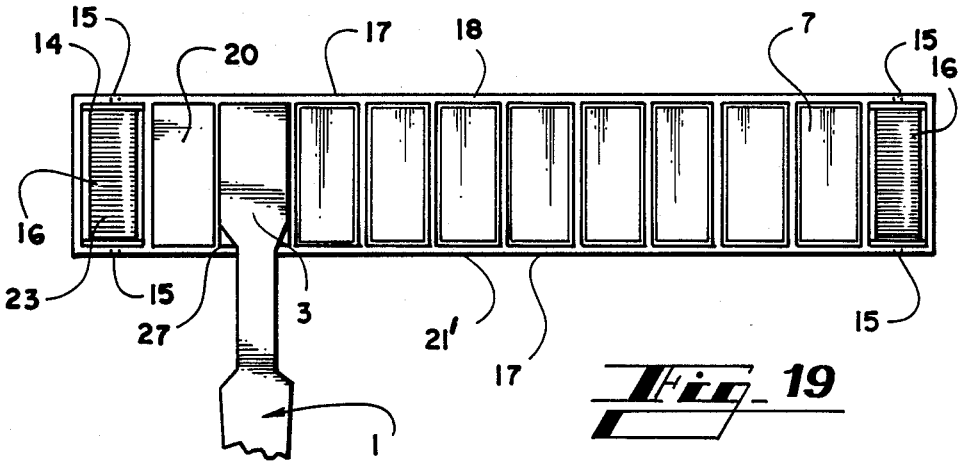

FIG. II is an exploded, front elevational view of the device shown in FIG. I;

FIG. III is a top plan view of a handle for use with the toothbrush of the present invention;

FIG. IV is a bottom plan view of the handle shown in FIG. III;

FIG. V is a left end elevational view of the handle shown in FIG. III;

FIG. VI is a side elevational view of a brush unit made in accordance with the present invention;

FIG. VII is an end elevational view of the brush unit shown in FIG. VI;

FIG. VIII is a top plan view of the brush unit shown in FIG. VI;

FIG. IX is a bottom plan view of the brush unit shown in FIG. VI;

FIG. X is a top plan view of the container shown in FIG. I;

FIG. XI is a bottom plan view of the container shown in FIG. X;

FIG. XII is a front elevational view of the container shown in FIG. X;

FIG. XIII is a view similar to FIG. X but showing a multiple layer container;

FIG. XIV is a bottom plan view of the container shown in FIG. XIII;

FIG. XV is a front-elevational view of the container shown in FIG. XIII;

FIG. XVI is an end elevational view of the container shown in FIG. XIII;

FIG. XVII is a transverse cross-sectional view through the container shown in FIG. XIII illustrating the brush unit compartment;

FIG. XVIII is a side elevational view of a complete toothbrush made in accordance with the present invention; and, FIG. XIX is a top plan view of the container of the present invention, and showing the handle engaging the unit.

DETAILED DESCRIPTION

Referring now to the drawings, in general, some embodiments of the present invention are illustrated and will be directed, in particular, to those elements forming part of or cooperating more directly with the present invention. Elements not specifically shown or described herein are understood to be selectable from those known in the art. Manufacturing materials not specifically described herein are understood to be selectable from those in the field, such as, for example, plastic, Lucite, wood, metal and any other suitable commercial and natural materials or combinations thereof.

The reusable handle unit 2 is best illustrated in FIGS. III–V and described herein as having a handle end region 6 shaped for manipulation by a user of the toothbrush and a handle head end region 3 having a recess 4 formed therein in a lower surface thereof shaped for mating with a larger upper portion 10, outwardly flared, of said base upper region 9 and said handle head end recess 4 having a recess rim 5, inwardly tapered, formed thereon on an outer edge thereof shaped for mating with a smaller lower portion 11, inwardly tapered, of said base upper region 9 so that said reusable handle unit 2 is thus releasably engageable with said hygienic disposable brush unit 7 for assemblage of the complete toothbrush 1 for utilizing. The toothbrush assembly 1 is manually assembled or is assembled in combination with said dispensing container storage 17 means.

The disposable brush unit 7 is best illustrated in FIGS. VI–IX and described herein having a base 8 having a base upper region 9 and a lower base region 12 said base upper region 9 having a larger upper portion 10, which defines an outwardly flared flange formed thereon being shaped in configuration for mating with said handle head end recessed area 4, said base upper region 9 having a smaller lower portion 11, inwardly tapered, formed thereon being shaped as a tongue-and-groove for mating with said handle head end recess rim 5 so that when said base larger upper portion 10 is forcibly inserted into said handle head end recessed area 4 said base upper larger portion 10 forcibly clears said head end recess rim 5 resilient compression and invades said handle head end recess area 4 and said base smaller lower portion 11, inwardly tapered, is simultaneously encompassed by said head end recess rim 5 whereby said outwardly flared larger upper portion 10 of said base upper region 9 is firmly seated within said head end recessed area 5 and said inwardly tapered smaller lower portion 11 of said base upper region 9 is firmly held by said encompassing said head end recess rim 5 in such a manner that said disposable brush unit 7 is firmly held in releasable engagement with said handle unit 3 for assemblage of the complete toothbrush 1 FIG. VII for utilizing.

The dispensing container 17 is illustrated in FIGS. X–XII and described herein as a container having base means 21 having a peripheral wall upstanding therefrom forming a unilinear section body member 18 for storing said reusable handle unit 2 and a plurality of said disposable brush units 7 wherein said unilinear section body member 18 further includes a plurality of spaced compartment partition walls 20' within said unilinear section body member 18 means and upstanding from said base means 21', said compartment partition walls 20' being disposed parallel to one another and substantially parallel to end portions of said peripheral wall to each define one respective compartment side wall 20' of a respective plurality of generally rectangular open-top compartments 20 disposed in a row, one respective compartment side wall 20' serving to define another respective compartment side wall 20' of an adjoining open-top compartment 20; the opposite ends of each respective compartment 20 being defined by portions of said peripheral wall such that said disposable brush units 7 stored therein in upright position being further retained in said respective open-top compartment 20 by an upper edge, 22' inwardly tapered, formed on one unlowered side wall 22 of said peripheral wall.

Said peripheral wall end portions have an upper edge, 22', inwardly tapered, for releasable attachment of said reusable handle unit 2 in frictional fit onto said top surface for said dispensing container 17. Said peripheral wall has one lowered side wall 21' portion associated with said open top compartment 20 to expose said base upper region 9 of said disposable brush unit 7 stored in upright position within said open-top compartments 20 for providing locating means 27 above said lowered side wall 21' and for providing access of the handle head end region 3 into an upper area of the open-top compartment 20 adjacent thereto for contact and releasable engagement of the handle head end region 3 and the disposable brush unit 7 for complete assemblage of the toothbrush assembly.

Said plurality of said disposable brush units 7 each is stored in said upright position within said row of said open-top compartments 20, said base upper larger regions thus forming a temporary covering for said unilinear section body member 18 for further protecting said disposable brush hygienic bristles 13 stored in said open-top compartments.

Said unilinear section body member 18 further includes a pair of closed-top end compartments 23 formed thereon having storage means permanently associated therewith for storing a pair of spool units 14 having each a pair of spool knob ends 15 wherein said closed-top end compartments 23 further include a pair of spool knob-end recesses 24 formed on opposite sides thereof for receiving said spool knob ends 15 for facilitating the storage of said spool units 14 carrying a supply of dental floss/tape 16. As illustrated in FIG. XVI, an end wall of the closed-top compartment includes a hole 25 and a cutting means 25'. One end of the dental floss 16 extends through the hole 25 and a strand is severed form the dental floss 16 by using the cutting means 25'.

Said unilinear body member 18 has means for stacking one unilinear section body member 18 on top of another unilinear section body member 18 for one multilinear section body member 19, said stacking means including said unilinear section body member 18 having an indentation 26 formed in each of the four corners thereof such that said base means 17' and said peripheral walls upstanding therefrom each receive a part of said indentation and whereas said unlowered side wall 22 portion of said peripheral wall and said two unlowered end wall 23' portions of said peripheral wall having an upper edge 22', inwardly tapered, continuously formed thereon such that said base corner indentations 26 cooperate with said upper edge 22', inwardly tapered, and respond to forcible manual pressure applied thereto, such that said upper edge 22' is forcibly caused to receive said indentations 26 in frictional fit and resilient retention for releasably stacking said plurality of said unilinear section body members 18 to form one multilinear section body member 19 for an unlimited supply of said inventive subject matter and whereas said stackable unilinear section body members 18 being unstackable by means of manual forcible pulling said unilinear section body members 18 away from each other for a reduction of said supply of inventive subject matter and for discarding said unilinear section body member 18 when empty of brush units 7.

Whereas when it is desired to utilize the toothbrush the handle unit 2 is manually forcibly disengaged from its position in storage means on the top surface of the dispensing container 17; the handle head end 3 having the lower altered portion held downward is then directed to engage the dispensing container 17 locating means 27 situated above and adjacent the lowered side wall 21' of the unilinear section body member 18 of the dispensing container 17 in an area coinciding with one of the plurality of open-top compartments 20 formed therein wherein is stored in an upright position one of the matching plurality of disposable brush units 7, for accurate contact of the handle head end 3 and the base upper region 9 of the hygienic disposable brush unit 7 stored therein, said handle head end region 3 is then manually forcibly further inserted thereinto to penetrate the open-top compartment 20 adjacent thereto for contact and releasable engagement of the handle head end region 3 the base upper region 9 of the disposable brush unit 7 stored therein for complete assemblage of the toothbrush assembly 1; the toothbrush assembly 1 is then forcibly ejected (not herein illustrated) from the dispensing container 17 through the open-top of the compartment 20 by means of an upward manual motion applied to the handle end region 6 of the complete toothbrush 1 now ready for utilizing. It is further anticipated in the best mode of operation that the disposable brush unit 7, once used, may be discarded by means of forcible manual push pull motion applied to the handle head end region 3 and the disposable brush base 8 in opposite directions so that the disposable brush unit 7 is forced to slide away from and clear the handle head end region 3 thus freeing the reusable handle unit 2 for replacement in storage means onto the top surface of the dispensing container 17 for future use in cooperation with a new disposable brush unit 7, having a base 8 carrying bristles 13, and preferably antiseptic bristles (not illustrated) stored in another compartment 20 of the dispensing container 17. There is also illustrated in FIG. VI the two closed-top end compartments 23 of the unilinear section 18 of the dispensing container 17 having spools 14 having knob ends 15 shown as installed in the spool knob-end recesses 24 the spools 14 carrying a content of dental floss/tape 16. In FIG. V there is illustrated a multilinear section body member 19 which is considered useful to the preferred embodiment of invention.

The improved toothbrush assembly 1 is further described as having means for manually forcibly slidably assembling the toothbrush assembly 1 independently of the dispensing container 17 by means of a simple push pull manual motion applied to the handle head end region 3 and the disposable brush unit 7 in opposite directions so that the disposable brush unit 7 is forced to slide onto the handle head end region 3 for firmly seating the reciprocally interlocking attaching devices of the disposable brush unit 7 and the reusable handle unit 2 for assembling of the toothbrush assembly 1 and so that said disposable brush unit is thus forcibly slidably separated from the reusable handle unit 2 for disassembling of the toothbrush assembly 1 for discarding the used disposable brush unit 7. It is further anticipated that the reusable handle unit 2 may be used in cooperation with any multiplicity of the disposable brush units 7 independently packaged of the inventive dispensing container.

It is to be noted that any suitable type of interlocking attaching device providing for releasable engagement of the head end 3 of the handle 2 with a plurality of hygienic disposable brush units 7 having a base 8 carrying bristles 13 is contemplated. While other devices could be used for the releasable engagement of the single reusable handle and the hygienic disposable brush unit 7, the previously described use of frictional engagement and resilient compression is presently preferred because of the ease of assembling the elements of the present invention to form the complete, improved toothbrush assembly 1.

The bristles 13 of the hygienic disposable brush unit 7, resembling ordinary toothbrush bristles, may be made from natural bristles or from man-made bristles resembling natural bristles, or bristles molded as plastic bristles or made or assembled in any other suitable manner for use in the common practice of brushing teeth. The bristles may vary in size, shape, density, hardness and other characteristics. Bristles conditioned as antiseptic bristles must have protective packaging for the maintenance of the antiseptic property of the bristles, and may be packaged as hygienic disposable brush units 7 for use in cooperation with a separate, more or less permanent, single reusable handle 2; or as a multiplicity of hygienic disposable brush units 7, for use with an accompanying separate single reusable handle 2, wherein, both elements are packaged and releasably contained in the inventive dispensing container 17.

While other interlocking attaching devices might be used for releasably storing the single reusable handle 2 onto and dispensed from the surface of the dispensing container 17 while not in use; and for releasably storing a plurality of the hygienic disposable brush units 7 within the dispensing container 17 while not in use; and for mutual releasable engagement of the elements of the toothbrush assembly while in use; and for releasable engagement of a multiplicity of stackable unilinear section body members 18 for a multilinear section body member 19 containing a plurality of hygienic disposable brush units 7 for an unlimited supply of the inventive subject matter, the previously described use of a combination of frictional engagement and resilient compression is presently preferred because of the following perceived benefits: the ease in assembling the inventive toothbrush assembly 1; the protective packaging afforded in releasably containing the plurality of hygienic disposable brush units having a base 8 carrying bristles 13, preferably antiseptic bristles (not illustrated) in the innovative dispensing container 17; and because of the additional convenience provided in using the innovative dispensing container 17, as a unilinear section body member 18, or as a multilinear section body member 19, for stackable, discardable, unilinear sections 18 having a plurality of open-topped compartments 20 for a containment of an unlimited plurality of the hygienic disposable brush units 7, for the purpose of providing maximum cost effective benefits to the manufacturer and maximum cost effective and convenience benefits to the user consumer.

The preceding and other advantages provided by the present invention should be readily apparent to those skilled in the art. Also, it should be appreciated that the previously described embodiments of the present invention have been set forth for illustrative purposes only. It is the intention that the present be limited only by the appended claims.

I claim:

1. Apparatus for brushing teeth, comprising:

(a) a reusable handle unit;

(b) a disposable brush unit having a base from which extends a plurality of bristles;

(c) means for said handle unit manually releasably engaging with said disposable brush unit; and (d) storage means for receiving said bristles, said base defining a closure for said storage means.

2. The combination of apparatus for brushing teeth as recited in claim 1, wherein said disposable brush unit base has an upper region shaped for releasable engagement with a head end of said reusable handle unit and a lower region carrying the bristles;

wherein said upper region has a larger upper portion outwardly flared; and a smaller lower portion, the larger upper portion and the smaller lower portion cooperating for mating said disposable brush unit with said handle head end, whereby when said base upper region is forceably, slideably engaged with said handle head end, said larger upper portion slides on a head end recess of said handle head end and said smaller lower portion receives an enveloping head end recess rim so that said disposable brush unit is firmly attached to said handle head end.

3. The combination of apparatus as recited in claim 1, wherein said storage means is a storage compartment having a base and a peripheral wall upstanding therefrom, the storage compartment having one opening for receiving the bristles into the compartment, the base of the disposable brush unit defining a cap to close said storage compartment.

4. The combination of apparatus as recited in claim 3, further comprising a dispensing container having a plurality of said storage compartments.

5. The combination of apparatus for brushing teeth as recited in claim 4, wherein said dispensing container further includes means for storing and dispensing a supply of dental floss

6. The combination of apparatus for brushing teeth as recited in claim 5, wherein said dispensing container further includes:

a pair of closed-top end compartments;

a pair of spool units, each having a length of dental floss wound on each said spool unit and a pair of spool knob ends;

a pair of spool knob-end recesses in two opposite walls of said closed-top compartment for receiving said spool knob-ends;

a hole pierced in a side wall thereof for outletting a strand of said dental floss; and means for cutting said strand of dental floss.

7. The combination of apparatus for brushing teeth as recited in claim 6, wherein said dispensing container further comprises:

an indentation formed in a plurality of corners of said base of said dispensing container such that said base of said dispensing container and said peripheral wall upstanding therefrom receive each a part of each of said indentations; and wherein said peripheral wall having an upper edge, inwardly tapered, along a back wall portion and two end wall portions, formed thereon;

so that when manual pressure is forceably exerted for pressing one said dispensing container onto a top of another said dispensing container, said respective base corner indentations of said one dispensing container cooperate with said respective upper edge, inwardly tapered of said another dispensing container for forcing said upper edge, inwardly tapered to receive said one dispensing container's respective corner indentations in reciprocal frictional fit for releasably stacking a plurality of said dispensing containers for forming of a stack of said dispensing containers; and wherein said releasably stackable dispensing containers are each reciprocally unstackable by forceably pulling said one dispensing container away from said another dispensing container.

8. The combination of apparatus for brushing teeth as recited in claim 4, wherein said dispensing container has a base and a peripheral wall upstanding therefrom;

a plurality of spaced partition walls within said dispensing container upstanding from said base, said partition walls being disposed parallel to one another and substantially parallel to end portions of said peripheral wall to each define one respective compartment side wall of a respective plurality of said open-top compartments disposed in a row, one respective side wall of one said open-top compartment serving to define another respective side wall of the adjoining open-top compartment, the opposite ends of each respective compartment being defined by portions of said peripheral wall, one of a plurality of disposable brush units being storably retained in one of said respective open-top compartments disposed in said row.

9. The combination of apparatus for brushing teeth as recited in claim 8, wherein said peripheral wall of said storage compartment has an upper edge inwardly tapered for securing said brush unit within said storage compartment.

10. The combination of apparatus for brushing teeth as recited in claim 4, wherein said dispensing container further comprises means for releasably storing said reusable handle unit in frictional fit on top of said dispensing container.

11. The combination of apparatus for brushing teeth as recited in claim 10, wherein said means for releasably storing said reusable handle comprises an upward edge inwardly tapered on end portions of said peripheral wall to receive and releasably hold said reusable handle unit in friction fit on top of said dispensing container.

12. The combination of apparatus for brushing teeth as recited in claim 3, wherein said storage compartment further comprises an upper edge, inwardly tapered, on one wall of said storage compartment, so that said base of said disposable brush unit is retained in said storage compartment.

13. The apparatus for brushing teeth as recited in claim 3, wherein said brush unit further comprises an upper region for engaging said handle unit, said upper region exposed from said storage compartment and said bristles are enclosed within said compartment.

14. The apparatus for brushing teeth as recited in claim 3, wherein said peripheral wall has a top edge engageable by said handle unit for locating contact with said base of said disposable brush unit.

15. The combination of apparatus for brushing teeth as recited in claim 1, wherein said base further comprises:

an upper region comprising:

a larger upper portion defining an outward flange; and a smaller lower portion adjacent the larger upper portion; and a lower region carrying said plurality of bristles.

16. The combination of apparatus for brushing teeth as recited in claim 15, wherein said reusable handle unit includes:

a handle end shaped for manipulation by a user of the reusable handle unit; and a handle head end region shaped for releasable engagement with said disposable brush unit; and wherein said handle head end has a recess formed therein in a lower surface area thereof being shaped for mating with said larger upper portion of said base upper region; and a recess rim, inwardly tapered, formed thereon on an outer edge thereof being shaped for mating with said smaller, lower portion of said base upper region;

whereby said handle head end region is forceably, slidably engaged onto said base upper region, said head end recess receives said base larger upper portion and said head end recess rim envelopes said base smaller, lower portion so that said handle head end is firmly attached with said disposable brush unit.

17. The apparatus for brushing teeth as recited in claim 16, wherein said storage means comprises a storage compartment having a base, a peripheral wall and one opening for receiving said bristles, an upper edge of the peripheral wall contactable by said handle unit for locating contact with said upper region of said disposable brush unit.

18. A disposable brush unit in a packaging system attachable to a handle for brushing teeth, comprising:

a brush unit base from which extends a plurality of bristles, the brush unit base engagable by the handle to assemble a tooth brush; and a compartment having one opening to receive the bristles, the opening sized to be closed by the brush unit base.

19. The disposable brush unit in a packaging system as recited in claim 18, wherein the brush unit base comprises an upper region and a lower region, the bristles extending from the lower region which engages an upper peripheral edge of the compartment so that the compartment is closed by the brush unit base, the upper region extending above the peripheral edge and exposed for locating engagement by the handle.

20. The disposable brush unit in a packaging system as recited in claim 19, wherein the upper peripheral edge cooperates with the handle for locating attachment of the handle with the brush unit base.

21. The disposable brush unit in a packaging system as recited in claim 18, wherein the brush unit base further comprises an outwardly flared upper portion and an inwardly tapered lower portion, which cooperate with a recess and a pair of side rims at an end of the handle for attaching said brush unit to the handle.

22. The disposable brush unit in a packaging system as recited in claim 18, wherein the compartment has a base and a peripheral wall upstanding therefrom, a portion of the peripheral wall lower than the remainder of the peripheral wall, the portion cooperating with the remainder to indicate the brush unit base for engagement by the handle.

23. The disposable brush unit in a packaging system as recited in claim 18, further comprising a container having a plurality of compartments, each compartment for receiving one disposable brush unit.

24. The disposable brush unit in a packaging system as recited in claim 23, further comprising means for stackably connecting the base of one container to a peripheral upper edge of a second container.

25. The disposable brush unit in a packaging system as recited in claim 24, wherein the means for stackably connecting comprises:

an indentation formed in the base of the container and the peripheral wall; and the peripheral wall having an inwardly tapered upper edge formed therein, so that one container connects to the second container by engaging the indentation of one container to the upper edge of the second container.

26. The disposable brush unit in a packaging system as recited in claim 23, further comprising means for attaching the handle to the container.

27. The disposable brush unit in a packaging system as recited in claim 26, wherein the means for attaching comprises an upper edge of the peripheral wall inwardly tapered to receive the handle.

28. The disposable brush unit in a packaging system as recited in claim 18, further comprising means for engaging the brush unit base and the handle without exposure of or contact with the bristles by a user assembling the toothbrush prior to moving the brush unit base upwardly from the compartment and thereby exposing the bristles.

29. The disposable brush unit in a packaging system as recited in claim 28, wherein the means for engaging the brush unit base and the handle comprises an upper region of the base extending above a peripheral edge of the compartment and exposed for engaging by the handle.

30. The disposable brush unit in a packaging system as recited in claim 18, further comprising means for storing and dispensing a supply of dental floss.

31. The disposable brush unit in a packaging system as recited in claim 18, further comprising means for retaining the brush unit base in the opening.

32. The disposable brush unit in a packaging system as recited in claim 31, wherein the means for retaining the base comprises an upper edge inwardly tapered of the compartment peripheral wall, so that the base is retained in the opening.

* * * * *